United States Patent [19]

Roper

[11] Patent Number: 4,526,352

[45] Date of Patent: Jul. 2, 1985

[54] DESLAGGING RAKE

[75] Inventor: Stephen J. Roper, Youngstown, Ohio

[73] Assignee: Pennsylvania Engineering Corporation, Pittsburgh, Pa.

[21] Appl. No.: 592,884

[22] Filed: Mar. 23, 1984

[51] Int. Cl.[3] ..... F27D 7/00

[52] U.S. Cl. ..... 266/228; 266/287

[58] Field of Search ..... 266/228, 227, 287

[56] References Cited

U.S. PATENT DOCUMENTS

| | | | |
|---|---|---|---|
| 3,610,603 | 10/1971 | Schmitz | 266/228 |
| 3,659,833 | 5/1972 | Grant | 266/228 |
| 3,712,601 | 1/1973 | Brown | 266/228 |
| 3,800,965 | 4/1974 | Barron | 214/32 |
| 3,883,124 | 5/1975 | Gaier | 266/228 |

FOREIGN PATENT DOCUMENTS

| | | | |
|---|---|---|---|
| 2305949 | 8/1974 | Fed. Rep. of Germany | 266/228 |

*Primary Examiner*—L. Dewayne Rutledge
*Assistant Examiner*—S. Kastler

[57] ABSTRACT

A deslagging rake includes a boom having a first section and a second section mounted on one end of the first section for pivotal movement about a vertical axis. A blade is mounted at the other end of the second section for pivotal movement about a generally horizontal axis. The boom may also include a support which engages the boom adjacent its other end and is mounted for pivotal movement about a second generally vertical axis.

7 Claims, 3 Drawing Figures

DESLAGGING RAKE

BACKGROUND OF THE INVENTION

This invention relates to deslagging rakes.

It is a common practice in the production of higher quality steel to remove slag from the surface of the molten metal after tapping and while the hot metal is contained in a ladle. For this purpose, a slag skimming rake is normally employed.

Prior art deslagging rakes normally comprise an elongate, extendable boom which is mounted on a support column for pivotal movement about a vertical axis. A downwardly extending skimming blade is disposed at the end of the boom and may be pivotal about a horizontal axis. In performing a skimming operation with prior art rakes, the boom is first extended over the tilted ladle. By extending and retracting the boom as well as by tilting either the boom or the blade about horizontal axis, the slag is removed from the upper surface of the molten metal. However, it was difficult to also remove slag adhering to the walls of the tilted ladle with prior art rakes.

SUMMARY OF THE INVENTION

It is an object of the invention to provide a new and improved slag skimming rake.

Another object of the invention is to provide a slag skimming rake which is not only capable of removing slag from the surface of the molten metal, but also from the walls of the tilted ladle.

These and other objects and advantages of the invention will become more apparent from the detailed description of the invention taken with the accompanying drawings.

In general terms, the invention comprises a deslagging rake having a main boom section and an auxiliary boom section mounted at the end of the main boom section for pivotal movement about a first axis. A rake is mounted at the opposite end of the auxiliary boom section for pivotal movement about a second axis which is perpendicular to a plane containing the first axis. First and second motive means are respectively coupled to the auxiliary boom section and the rake for pivoting the same about their respective axes.

DETAILED DESCRIPTION OF THE PREFERRED EMBODIMENT

Figure 1:
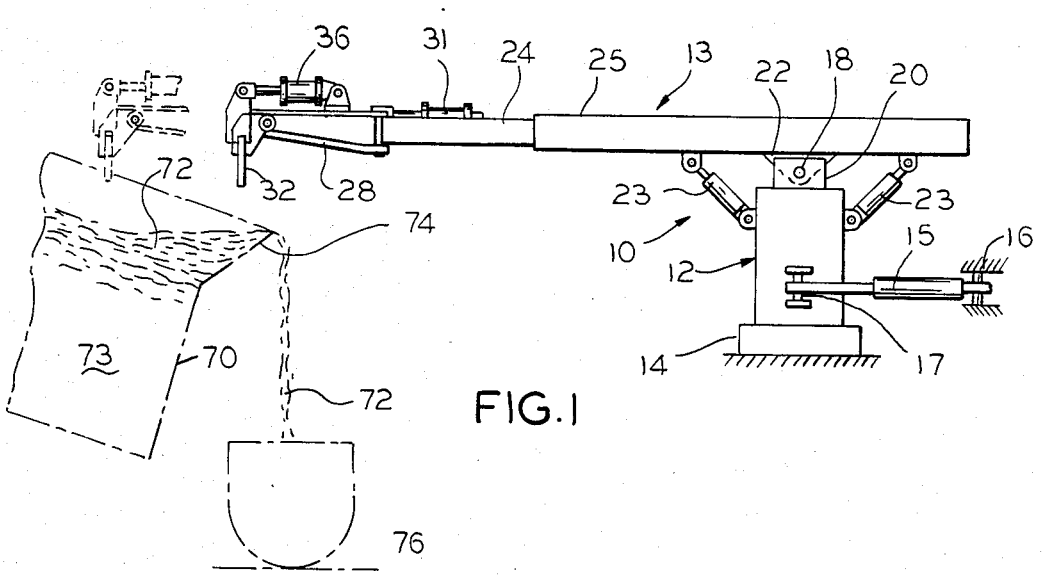
FIG. 1 is a side elevational view of a slag skimming rake in accordance with the preferred embodiment of the invention.

FIG. 1 schematically illustrates a deslagging rake 10 according to the present invention to include a support column 12 and a boom 13. Column 12 is supported on a bearing 14 for rotation about a generally vertical axis under the influence of any suitable drive means such as a cylinder 15 which is pivotally connected at one end to a fixed support 16 and at its other end to one side of the column 12 at 17. The boom 13 is also pivotally mounted intermediate its ends at the upper in the upper end of the column 12 by means of a shaft 18 which extends transversely through suitable bearing 20 disposed at the upper end of column 12, and brackets 22 affixed below the boom 13. A pair of cylinders 23 are each pivotally connected at one end to the column at points which are on the opposie opposite sides of shaft 18 and the other end of each cylinder 23 is pivotally connected to the underside of boom 13 and along longitudinally spaced apart points. It will be appreciated that the boom 13 may be pivoted in a horizontal plane about the axis of column 12 under the influence of cylinder 15 and may be rocked in a vertical plane about the axis of shaft 18 under the influence of cylinders 23.

The boom 13 is extensible in any suitable manner known in the art which forms no part of the present invention and accordingly will not be discussed in detail for the sake of brevity. For purposes of illustration, the boom 13 is shown to have telescoping sections 24 and 25. It will be appreciated that section 24 is supported on bearings (not shown) disposed in section 25 for axial movement by any suitable means, such as, a hydraulic cylinder (not shown).

Figure 2:
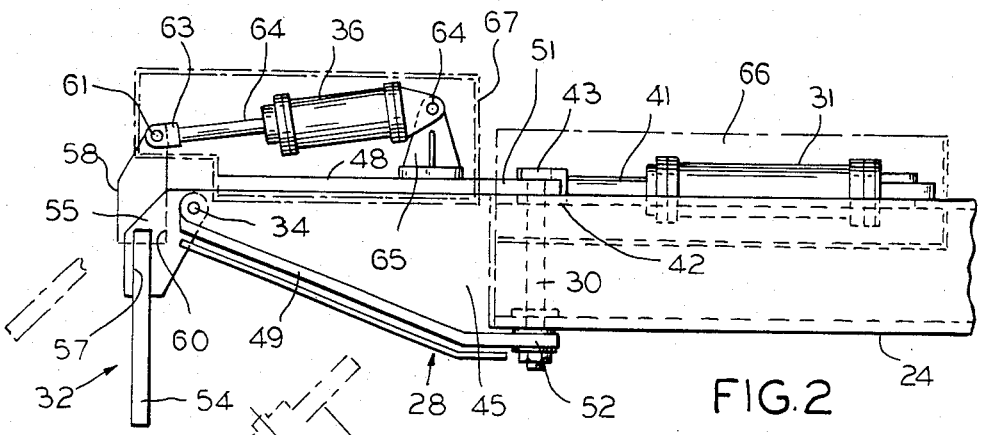
FIG. 2 is a top planned view of a portion of the deslagging rake shown in FIG. 1.
Figure 3:
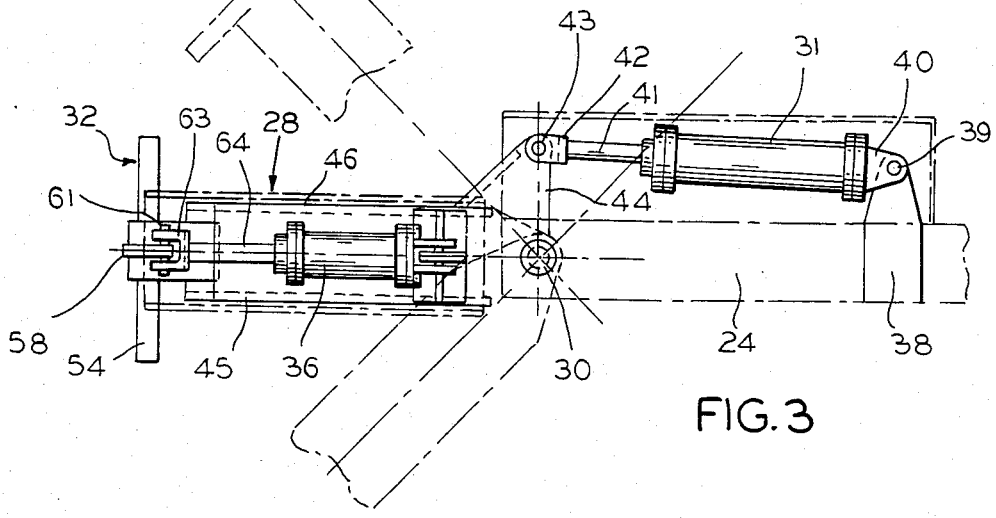
FIG. 3 is a side view of the deslagging rake portion shown in FIG. 2.

As shown more particularly in FIGS. 2 and 3, there is a third boom section 28 mounted at the end of boom section 24 by means of a pin 30 for pivotal movement about a vertical axis under the influence of a first cylinder 31. A rake 32 is mounted at the other end of section 28 by means of a pin 34 for pivotable movement about a generally horizontal axis under the influence of a second cylinder 36.

In particular, the boom section 24 may comprise a box beam having a bracket 38 affixed to its upper surface and extending laterally. A pivot pin 39 extends through aligned openings in bracket 38 and a forked coupler 40 on the end of cylinder 31 for pivotally supporting the same. A piston rod 41 extending from cylinder 31 has a forked member 42 at its remote end which is pivotally connected by a pin 43 to a bracket 44 extending laterally from beam section 28. As seen in FIG. 3, the axes of pins 30 and 43 lie in substantially the same vertical plane.

The boom section 28 is hollow and rectangular in vertical section. This configuration is defined by a pair of generally triangular, parallel, spaced apart side plates 45 and 46 which are tapered from their rear to their front ends. In addition, there are top and bottom plates 48 and 49 which are respectively affixed to the upper and lower edges of the side plates 45 and 46 so that the top plate 48 extends generally horizontally and the bottom plate 49 is inclined upwardly from its rear to its front end. At the rear of each of the top and bottom plates 45 and 46 are ears 51 and 52, respectively, which extend in parallel spaced apart relation and are apertured for receiving pin 30 which also extends through aligned apertures in the forward end of beam section 24 whereby the section 28 is pivotally mounted.

The rake 32 comprises a generally rectangular plate 54 and a support 55 body which is pivotally mounted between the forward ends of the side plates 45 and 46 of beam section 28 by pin 34. More specifically, the plate 54 is affixed in a slot 57 formed in body 55 and extending upwardly from its lower end. In addition, a second plate 58 is affixed in a second slot 60 formed in the upper end of body 55 and generally perpendicular to the slot 57. A pin 61 extends transversely through aligned openings in the upper end of plate 55 and a forked member 63 affixed to the front end of a rod 64 extending from one end of cylinder 36. The other end of cylinder 36 is pivotally mounted by pin 64 on a bracket 65 extending upwardly from plate 48 and in alignment with plate 55.

Housings 66 and 67 may be mounted on beam sections 24 and 28 and in surrounding relation to the cylinders 31 and 36 respectively to protect the same from slag. A third shield 68 may be disposed below plate 49 of section 28.

In operation, a ladle 70 containing hot metal will be supported adjacent the deslagging rake 10. The ladle will then be tilted and the boom 24 is extended and pivoted so that it is in the position to engage slag 72 floating on the surface of the hot metal 73. The boom 24 is then reciprocated and the rake 32 tilted to draw the slag through the pouring spout 74 and downwardly and to a slag bucket 76. When it is desired to also remove slag from the sides of the ladle 70, the boom section 28 is pivoted under the influence of cylinder 31 about pin 30. This places the edges of plate 54 adjacent the walls of the ladle 70. In addition, the plate 54 may be tilted about the axis of pin 34 so that the edge of plate 54 can conform to the ladle wall. In this manner, slag may be removed from the ladle wall in addition to the surface of the molten metal bath.

While only a single embodiment of the invention has been illustrated and described, it is not intended to be limited thereby but only by the scope of the appended claims.

I claim:

1. A deslagging rake comprising:

a main boom section, an auxiliary boom section mounted at the end of the main boom section for pivotal movement about a substantially vertical axis, said auxiliary boom section being shorter than said main boom section, a rake mounted at the opposite end of said auxiliary boom section for pivotal movement about a substantially horizontal axis, first and second motive means selectively coupled to said auxiliary boom section and said rake for pivoting the same about their respective pivotal axes.

2. The deslagging rake set forth in claim 1 wherein said first motive means comprises a first cylinder pivotally connected at one end to said main boom section and at its other end to said auxiliary boom section, said second motive means comprising a second cylinder pivotally connected at one end to said auxiliary boom section and at its other end to said rake.

3. The deslagging rake set forth in claim 2 wherein said first cylinder is pivotally mounted adjacent its opposite ends on a first bracket means extending laterally from said main boom section and a second bracket extending laterally from said auxiliary boom section and in general alignment with the first pivot axis.

4. The deslagging rake set forth in claim 3 wherein one end of said second cylinder is pivotally mounted on a first bracket extending upwardly from said auxiliary boom section and a second bracket extending upwardly from said rake.

5. The deslagging rake set forth in claim 4 wherein said main boom section is pivotally mounted about a third axis parallel to and spaced from said substantially vertical axis whereby said main boom section and said auxiliary boom sections may pivot in unison and said auxiliary boom section my pivot relative to said main boom section.

6. A deslagging rake comprising:

an elongate boom section, a rake, a support for said rake, said rake being pivotally mounted on said support for movement about a generally horizontal axis, said support being shorter than said boom section and mounted adjacent the end of said boom section for pivotal movement about a generally vertical axis so that said rake is moved in a generally horizontal circular path about said vertical axis, and motive means for independently pivoting said rake on said support and about said horizontal axis and said support on said boom and about said vertical axis whereby said rake can be moved into remote areas of a container of molten metal.

7. The assembly set forth in claim 6 wherein said boom is pivotally mounted about a horizontal axis and is extendable whereby said support may be advanced toward a container of molten metal.

* * * * *